US008657481B2

(12) United States Patent
Collins

(10) Patent No.: US 8,657,481 B2
(45) Date of Patent: Feb. 25, 2014

(54) SYSTEMS AND METHODS FOR MIXING FLUIDS

(75) Inventor: Keith Collins, Milford, CT (US)

(73) Assignee: Spine Wave, Inc., Shelton, CT (US)

( * ) Notice: Subject to any disclaimer, the term of this patent is extended or adjusted under 35 U.S.C. 154(b) by 1078 days.

(21) Appl. No.: 12/688,513

(22) Filed: Jan. 15, 2010

(65) Prior Publication Data

US 2011/0176382 A1 Jul. 21, 2011

(51) Int. Cl.
*B01F 13/00* (2006.01)

(52) U.S. Cl.
USPC ..... 366/130; 366/268; 604/86; 604/89; 141/27; 141/329

(58) Field of Classification Search
USPC ..... 366/130, 176.3, 267, 268, 333; 604/87, 604/88, 89; 141/26, 27, 329
See application file for complete search history.

(56) References Cited

U.S. PATENT DOCUMENTS

| | | | | | |
|---|---|---|---|---|---|
| 1,234,582 | A | * | 7/1917 | Trueblood | 604/191 |
| 1,557,836 | A | * | 10/1925 | Hein | 604/237 |
| 2,477,598 | A | * | 8/1949 | Hain | 366/334 |
| 3,010,705 | A | | 11/1961 | Brown | |
| 3,108,591 | A | * | 10/1963 | Kolbas | 604/88 |
| 3,477,432 | A | * | 11/1969 | Shaw | 604/91 |
| 3,489,147 | A | * | 1/1970 | Shaw | 604/88 |
| 3,526,391 | A | | 9/1970 | Church, Jr. | |
| 3,527,216 | A | * | 9/1970 | Snyder | 604/88 |
| 3,570,486 | A | * | 3/1971 | Engelsher et al. | 604/88 |
| 3,621,843 | A | * | 11/1971 | Metten | 604/88 |
| 3,700,215 | A | * | 10/1972 | Hardman et al. | 366/268 |
| 3,729,031 | A | | 4/1973 | Baldwin | |
| 3,785,379 | A | * | 1/1974 | Cohen | 604/88 |
| 3,860,218 | A | | 1/1975 | Hurlimann | |
| 4,171,698 | A | * | 10/1979 | Genese | 604/88 |
| 4,581,016 | A | * | 4/1986 | Gettig | 604/88 |
| 4,743,229 | A | * | 5/1988 | Chu | 604/82 |
| 4,979,942 | A | | 12/1990 | Wolf et al. | |
| 5,067,948 | A | * | 11/1991 | Haber et al. | 604/213 |
| 5,176,642 | A | * | 1/1993 | Clement | 604/135 |
| 5,334,162 | A | * | 8/1994 | Harris | 604/232 |
| 5,378,233 | A | * | 1/1995 | Haber et al. | 604/83 |

(Continued)

FOREIGN PATENT DOCUMENTS

| | | | |
|---|---|---|---|
| WO | WO9608227 | A1 | 3/1996 |
| WO | 2009/094345 | A1 | 7/2009 |

OTHER PUBLICATIONS

Preliminary search report PCT/US2011/020467, forms PCT/IB/373 and PCT/IB/237, opinion dated Feb. 2011, total 5 pages.*

(Continued)

*Primary Examiner* — Tony G Soohoo
(74) *Attorney, Agent, or Firm* — Hoffmann & Baron, LLP

(57) ABSTRACT

A syringe-to-syringe mixing apparatus comprises first and second syringes adapted to be coupled at their respective outlets to fluidly connect the syringes. The first syringe includes a plunger having a hollow plunger barrel and a distal end defining a lumen therethrough. The lumen is initially closed by a septum, which in one embodiment is an elastomeric stopper mounted over the end of the plunger. The mixing apparatus further includes a third syringe slidably disposed within the plunger barrel. The third syringe includes a hollow needle adapted to pierce the septum to allow fluid from the third syringe to be injected into fluid within the coupled first and second syringes.

6 Claims, 4 Drawing Sheets

(56) References Cited

U.S. PATENT DOCUMENTS

| | | | | |
|---|---|---|---|---|
| 5,425,580 | A * | 6/1995 | Beller | 366/131 |
| 5,637,100 | A * | 6/1997 | Sudo | 604/238 |
| 5,876,372 | A * | 3/1999 | Grabenkort et al. | 604/89 |
| 5,908,054 | A * | 6/1999 | Safabash et al. | 141/26 |
| 5,951,160 | A | 9/1999 | Ronk | |
| 5,957,166 | A * | 9/1999 | Safabash | 141/26 |
| 5,971,953 | A * | 10/1999 | Bachynsky | 604/90 |
| 6,062,722 | A | 5/2000 | Lake | |
| 6,234,196 | B1 | 5/2001 | Fischer et al. | |
| 6,544,233 | B1 * | 4/2003 | Fukui et al. | 604/191 |
| 8,109,902 | B2 * | 2/2012 | Middleton et al. | 604/82 |
| 2003/0236497 | A1 * | 12/2003 | Fremming et al. | 604/126 |
| 2004/0092883 | A1 | 5/2004 | Casey, II et al. | |
| 2005/0209555 | A1 | 9/2005 | Middleton et al. | |
| 2008/0188828 | A1 * | 8/2008 | Reynolds et al. | 604/520 |
| 2009/0112157 | A1 | 4/2009 | Jessop | |
| 2009/0247985 | A1 * | 10/2009 | Melsheimer et al. | 604/506 |

OTHER PUBLICATIONS

International Search Report, International Application No. PCT/US2011/020467.

* cited by examiner

SYSTEMS AND METHODS FOR MIXING FLUIDS

BACKGROUND

This invention relates to systems and methods for mixing fluids, and particularly medical fluids. More specifically, the invention relates to improvements in syringe-to-syringe mixing systems.

Several systems have been developed for on-site mixing and dispensing multi-part medical and dental compositions. One system uses dual-cartridge syringes with static mix tips. These systems are generally not adequate for mixing polymers with high mix ratios. A further drawback is that a considerable amount of material is wasted in the mix tip, which may not be problematic for low cost fluid compounds but is potentially prohibitive for expensive materials, such as an injectable disc nucleus material.

Another system, known as a continuous flow system, uses an electromechanical apparatus that drives a mix tip for controlled mixing of the fluids. Continuous flow systems are best suited for "assembly line" production and are often too expensive for mixing single batches of fluid compounds.

A system that is very compatible for mixing small batches includes two medical syringes connected by an adapter so that fluids can be pushed back and forth between the syringes. This type of system includes two syringes coupled by an adapter. The adapter includes a uniform passageway that allows flow of fluid from one syringe to the other as the plungers of the syringes are alternately depressed.

Syringe-to-syringe adapters have been used to couple a large reservoir syringe with a small dose syringe to simply transfer fluid from one to the other. These adapters have also been used to sequentially couple different syringes to a single syringe, with each of the syringes carrying a different fluid or a granular compound to mix with the fluid in the single syringe. In some cases, the two syringes contain different fluids that must be thoroughly mixed. This mixing occurs by alternately depressing the plungers of the opposing syringes so that the fluids flow back and forth through the adapter. Once the fluid transfer or mixing is complete, the syringes are uncoupled and one or both of the syringes can be used as an applicator or injection device.

For many types of fluids and fluid compounds, this mixing approach is sufficient. For instance, many emulsions are prepared through syringe-to-syringe mixing. In these prior devices, the constant diameter passageway in the adapter allows full uniform flow of the fluid through the adapter, and the resultant mixture is complete enough for the particular medical application. One drawback of these prior systems is that they require relatively high plunger forces when mixing viscous fluids, which can lead to user fatigue. Another problem is that it is time consuming to achieve uniform distribution of micro-droplets within a fluid mixture.

Furthermore, in certain medical applications, the degree of mixing that can be accomplished is less than optimum, particularly where high mix ratios are involved. For instance, certain injectable disc nucleus (IDN) compositions can have mix ratios between two constituents (i.e., polymer and cross-linker) greater than 10:1, and even greater than 100:1. The entire composition fails if the lower concentration constituent (such as the cross-linker in the case of an IDN) is not fully mixed within the other constituent (the polymer).

This mixing problem is also critical where the fluids combine to form a curable composition. In this case, as the different fluids are mixed they begin to cure, congeal or harden. For some materials, the curing time is sufficiently long so that the mixture can be cycled back and forth between the syringes enough times to ensure complete mixing of the constituents. For instance, many bone cements can be mixed using these types of prior devices.

However, the time necessary to achieve complete mixing is prohibitive for some curable materials that cure relatively quickly. If these types of materials are not dispensed in a timely manner, the mixture is worthless. For example, one type of chemical composition known as a hydrogel is formed by mixing a polymer with a cross-linker. The resulting mixture starts to cure immediately when the constituents come into contact. For some hydrogels, the curing time is under two minutes. In these cases, it is imperative that the fluid mixing occur as quickly and completely as possible so that the surgeon has enough time remaining to inject the hydrogel at the surgical site.

The short curing times essentially prohibit mixing the constituents in any system other than a system that permits immediate injection of the mixture. In other words, syringe-to-syringe mixing is the most viable alternative for fluid compounds having short curing times.

Consequently, there is a need for a syringe-to-syringe system that yields complete mixing in conditions that include one or more of the following parameters:

High mix ratios (e.g., much greater than 10:1);
Immiscible fluids;
Rapidly curing polymers; and
High viscosity fluids.

SUMMARY

The present invention provides a syringe-to-syringe mixing apparatus that addresses these unresolved needs. In one embodiment, the syringe-to-syringe mixing apparatus comprises a first syringe including a first hollow barrel having an outlet and defining a first chamber for containing a fluid, and a second syringe including a second hollow barrel having an outlet and defining a second chamber for containing a fluid. The second syringe includes a second plunger slidably disposed within the second barrel. The first and second syringes are adapted to be coupled at the respective outlets to fluidly connect the first and second chambers. In one feature, the first syringe includes a first plunger slidably disposed within the first barrel in which the first plunger has a hollow plunger barrel defining a plunger chamber and a distal end defining a lumen therethrough in communication between the plunger chamber and the first syringe chamber when the plunger is disposed within the first barrel. The apparatus further comprises a third syringe slidably disposed within the plunger barrel. The third syringe defines a cavity for containing a fluid and a third plunger slidably disposed within the cavity to inject that fluid into the other syringe chambers.

In a further feature, the first plunger includes a septum closing the lumen and the third syringe includes a hollow needle configured to pierce the septum. The needle is in fluid communication with the cavity of the third syringe. In use of the apparatus, at least one of the syringes contains a fluid when it is coupled to another syringe. The third syringe is depressed within the plunger chamber of the first syringe so that the needle pierces the septum. The fluid within the third syringe is injected into the other fluid and the needle is retracted with the septum sealing behind the needle. The plungers of the first and second syringes are then alternately depressed to fully mix the fluids.

In one embodiment, the septum is a stopper mounted over the distal end of the first plunger. The stopper is formed of a resilient material adapted to be pierced by the needle, to maintain a seal about the needle, and to "re-seal" once the needle has been removed. The stopper may include an elongated tip defining the septum, the tip being substantially axially aligned with the lumen in the first plunger.

In another aspect, the first syringe defines a nozzle at the outlet configured to increase the velocity of fluid flowing therethrough under pressure from one of the first and second plunger when the first and second syringes are coupled.

In another embodiment, a syringe assembly is provided for use with another syringe in a syringe-to-syringe mixing assembly, the syringe assembly comprising a first syringe including a first hollow barrel having an outlet and defining a first chamber for containing a fluid, the first syringe configured to be coupled to another syringe to fluidly connect the syringes. The first syringe includes a first plunger slidably disposed within the first barrel, the first plunger having a hollow plunger barrel defining a plunger chamber and having a distal end defining a lumen therethrough in communication between the plunger chamber and the first chamber when the plunger is disposed within the first barrel. An additional syringe slidably disposed within the plunger barrel, the additional syringe defining a cavity for containing a fluid and a plunger slidably disposed within the cavity.

In one feature of this embodiment, the first plunger includes a septum closing the lumen and the additional syringe includes a hollow needle configured to pierce the septum, the needle in fluid communication with the cavity. The septum may be a stopper mounted over the distal end of the first plunger, the stopper formed of a resilient material adapted to be pierced by the needle.

In a further embodiment, a syringe assembly is provided for use with another syringe in a syringe-to-syringe mixing assembly, the syringe assembly comprising a syringe including a hollow barrel having an outlet and defining a chamber for containing a fluid and a plunger slidably disposed within the barrel, the syringe configured to be coupled to another syringe to fluidly connect the syringes. The outlet defines an elongated passageway in communication with the chamber and a hub defining a lumen transverse to and in fluid communication with the passageway. The lumen is closed by a septum.

The syringe assembly further comprises an injector assembly including a hollow injector barrel defining an injector chamber and a plunger slidably disposed therein, the injector chamber terminating in a needle adapted to pierce the septum of the lumen, the injector barrel including an engagement fitting configured to mate with the hub.

DESCRIPTION OF THE PREFERRED EMBODIMENTS

Figure 1:
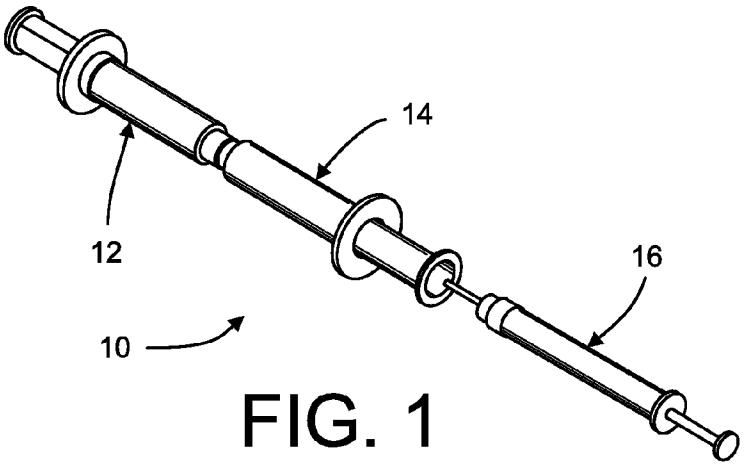
FIG. 1 is perspective view of a syringe-to-syringe mixing system according to the present disclosure.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 2:
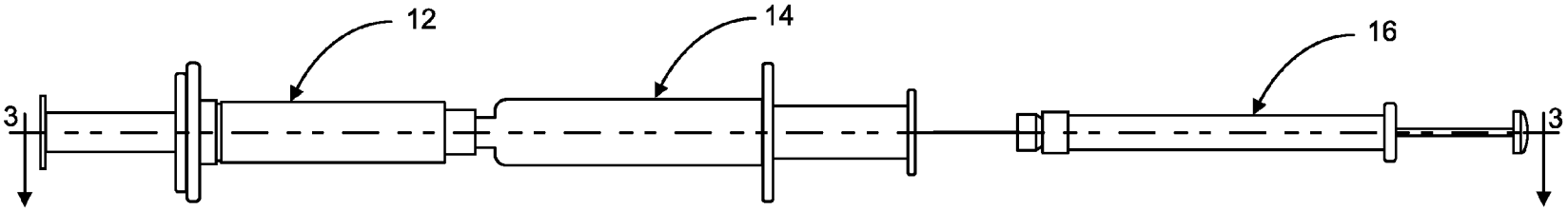
FIG. 2 is a side view of the mixing system shown in FIG. 1.

The present invention contemplates a mixing apparatus 10 utilizing a pair of syringes 12 and 14, with the addition of a third syringe 16 as shown in FIGS. 1-2. Referring to the cross-sectional views of FIGS. 3-4, the syringe 12, or the secondary syringe, may be in the form of a conventional syringe having a hollow barrel 20 with a fitting 22 at the tip of the syringe. The barrel defines a chamber 24 that slidably receives a plunger 26, with the head 27 of the plunger arranged to dispense fluid through an outlet 28*a* at the engagement tip 28 of the secondary syringe.

The other syringe 14, or the primary syringe, includes a hollow barrel 30 defining a chamber 36 configured for slidably receiving a plunger 40. The volume of the two cavities 24 and 36 may be comparable, and more particularly are sized to permit syringe-to-syringe mixing by alternately depressing the corresponding plungers 26 and 40. The primary syringe 14 includes a fitting 32 that is adapted to mate with the fitting 22 of the secondary syringe 12, as shown in detail in FIG. 4. The two fittings may be LUER® fittings, as is conventional in the art, to provide a quick connect and disconnect capability. However, any fitting is suitable that provides a strong fluid-tight engagement between the two syringes, such as a threaded engagement.

The fitting 32 defines an engagement cavity 38 with an outlet 38*a* that is configured for a fluid tight engagement with the engagement tip 28 of the secondary syringe 12. The engagement cavity 38 and engagement tip 28 may be tapered, as shown in FIG. 4, to facilitate a fluid-tight engagement between the two syringes.

Figure 4:
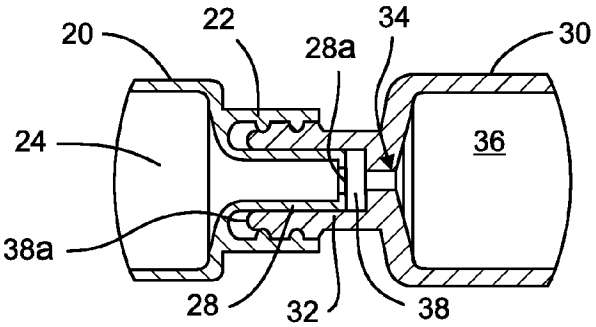
FIG. 4 is an enlarged view of the area B of the mixing system shown in FIG. 3.
Figure 5:
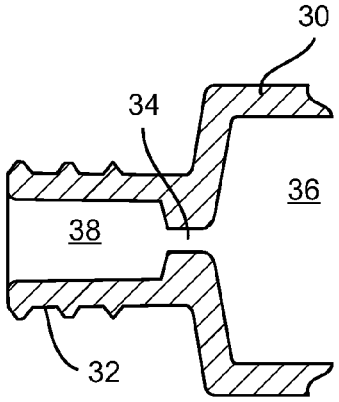
FIG. 5 is a side cross-sectional view of the tip of one syringe used in the mixing system shown in FIG. 2.

As illustrated in FIGS. 4 and 5, the primary syringe 14 defines a nozzle 34 between the chamber 36 and the engagement cavity 38. The nozzle 34 defines a reduced diameter relative to the chamber and the internal diameter of the engagement tip 28 of the secondary syringe. The nozzle thus increases the velocity of fluid flowing between the two syringes, which produces increased shear rates between the fluids being transferred and mixed. Increased shear rates create droplets out of the bulk fluids being mixed. As these droplets are discharged through the nozzle 34 at high velocity they are broadly dispersed through the fluid in the opposite or receiving chamber, resulting in a homogeneous mixture and/or suspension of the component fluids. In one specific embodiment, the barrel 30 of the primary syringe 14 defines a chamber diameter of about 0.494 in., while the engagement tip 28 of the secondary syringe 12 defines an opening diameter of about 0.100 in. The nozzle 34 in the specific embodiment has a diameter of 0.047 in., less than half the diameter of the tip opening. As depicted in FIG. 5, the entrance and exit from the nozzle 34 may be tapered from the diameter of the adjacent spaces. In the specific example, the nozzle includes 45° and 100° conical tapers at its opposite ends to transition into the adjacent spaces.

Figure 6:
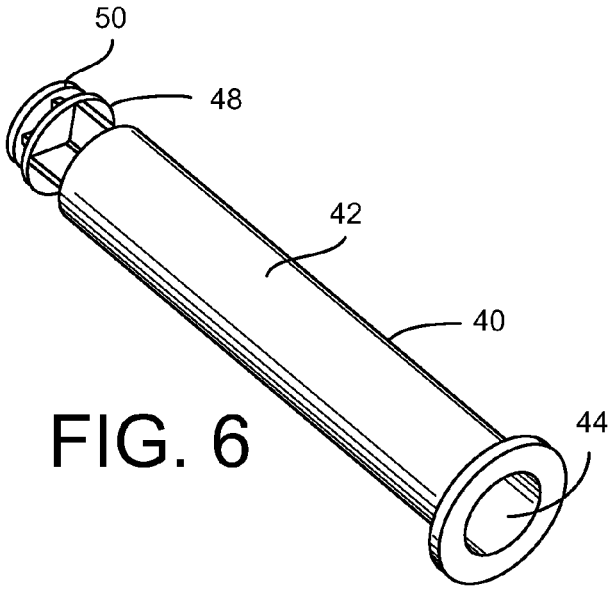
FIG. 6 is a perspective view of a syringe plunger used in the mixing system shown in FIG. 2.
Figure 7:
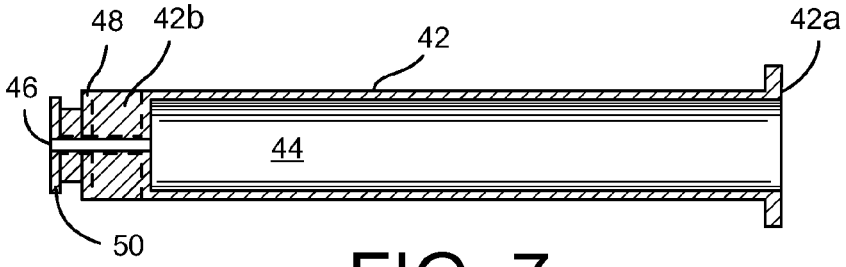
FIG. 7 is a side cross-sectional view of the plunger shown in FIG. 6.
Figure 8:
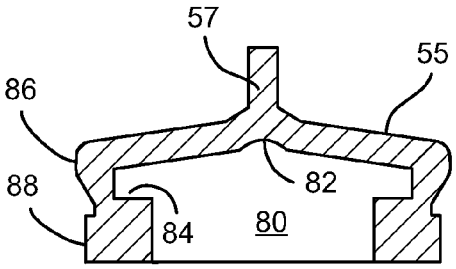
FIG. 8 is an enlarged side cross-sectional view of a stopper mounted to the plunger shown in FIG. 3.

The primary syringe 14 incorporates a plunger 40 that includes a hollow barrel 42 defining a chamber 44, as shown in FIGS. 6 and 7. The proximal end 42*a* of the barrel is open while the opposite distal end 42*b* includes a discharge lumen 46. The distal end 42*b* forms a sealing disc 48 that is configured for a tight running fit within the chamber 36 of the primary syringe barrel. Offset from the sealing disc is an engagement disc 50 that is configured to support a stopper 55 (FIG. 8). As shown in FIG. 6, the distal end 42*b* of the plunger 40 may incorporate a crossed vanes structure supporting the discs 48 and 50. The vane structure reduces the amount of material at the distal end while preserving enough material to define the discharge lumen 46.

Figure 3:
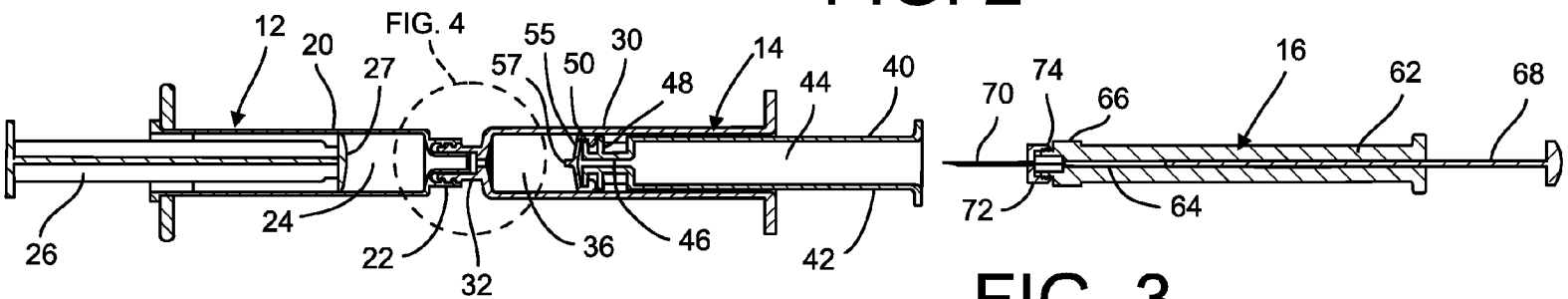
FIG. 3 is a side cross-sectional view of a syringe-to-syringe mixing system shown in FIG. 2, taken along line A-A.

As shown in FIG. 3, the plunger 40 supports a stopper 55 that is configured for a fluid-tight sliding fit within the chamber 36 of the primary syringe. As shown in more detail in FIG. 8, the stopper 55 includes an elastomeric body 56 that defines a tip 57 at one end and an open cavity 80 at an opposite end. The cavity is configured to receive the engagement disc 50 of the plunger 40, in particular within a circumferential recess 84. The stopper may be mounted over the engagement disc by deforming the stopper at the open cavity 80 as the stopper 55 is pressed onto the disc 50. Once the disc is seated within the circumferential recess, the discharge lumen 46 is aligned with a guide depression 82 aligned with the stopper tip 57.

Figure 9:
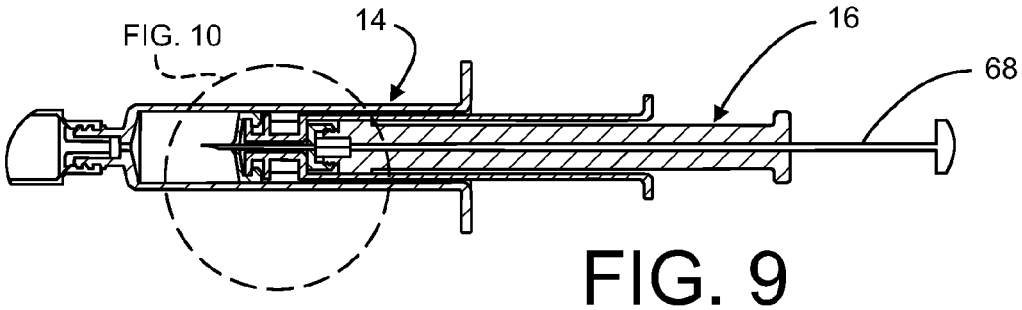
FIG. 9 is a side cross-sectional view of the mixing system depicted in FIG. 3, shown in an operative condition.
Figure 10:
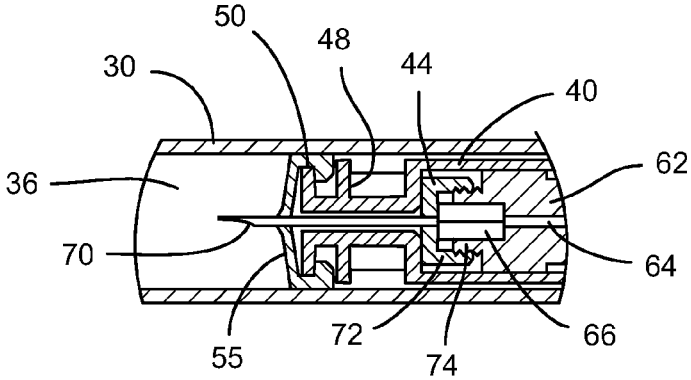
FIG. 10 is an enlarged cross-sectional view of the area D in FIG. 9.

The stopper 55 may incorporate an enlarged proximal portion 88 that is configured to fit between the discs 48 and 50 of the plunger. This enlarged portion helps stabilize the stopper on the plunger and may also be configured to provide a sealing surface for sliding fluid-tight engagement with the barrel 30 of the primary syringe. The stopper may also define a forward sealing surface 86 adjacent the stopper tip 57 that is also configured for a sliding fluid-tight engagement with the syringe barrel, as depicted in FIGS. 3, 9 and 10.

The plunger 40 defines a chamber 44 that receives the third syringe 16 of the assembly 10, namely the additive syringe. The additive syringe 16 includes a body 62 that defines a lumen 64 along the entire length of the body. A plunger 68 is slidably disposed within the lumen 64 for a fluid-tight running fit. The additive syringe includes a piercing needle 70 mounted to the distal end 66 of the syringe. The body 62 and piercing needle 70 may define mating elements 72 and 74, respectively, which provide a fluid-tight engagement. As shown in the detail view of FIG. 10, the mating elements 72, 74 may constitute a threaded engagement. The needle 70 is hollow and in fluid communication with the lumen 64 of the additive syringe 16. The needle 70 is configured to pierce the tip 57 of the stopper 55, as described below. The stopper tip is resilient so that it operates as a septum to forms a tight seal about the needle when the needle pierces the tip and to "reseal" once the needle has been removed.

Figure 11A:
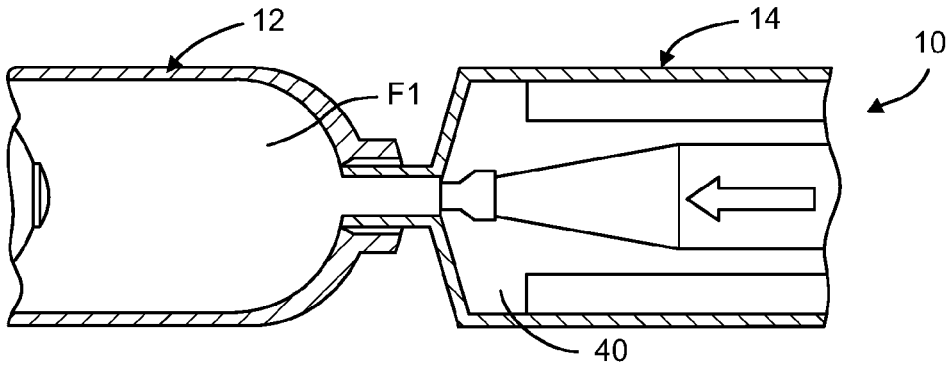
FIGS. 11*a-c* are side views showing a sequence of operation of the mixing system shown in FIGS. 1-3.
Figure 11B:
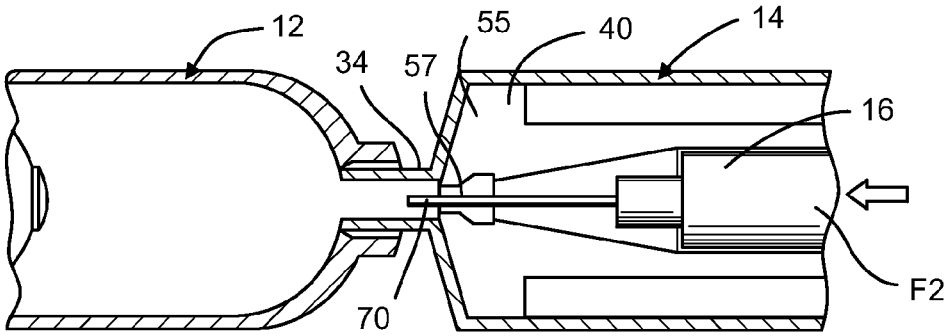
Figure 11C:
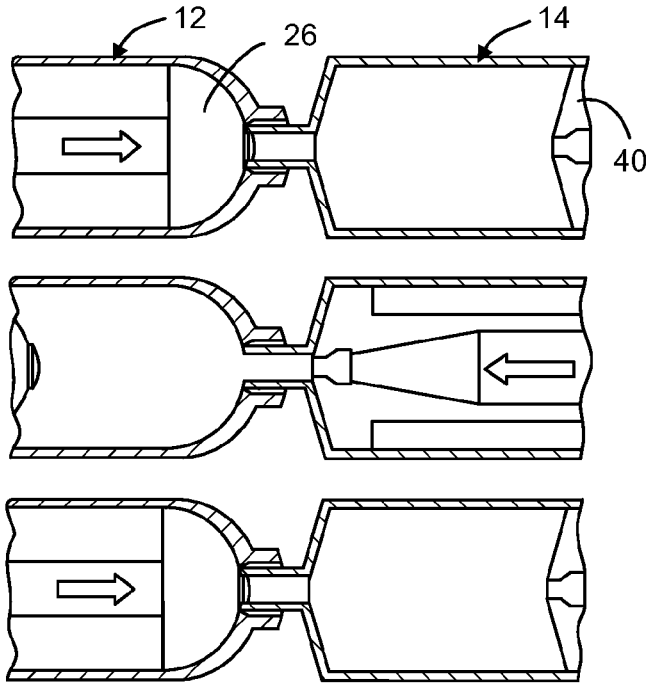

The operation of the mixing assembly 10 is illustrated in FIGS. 11*a-c*. In the first step shown in FIG. 11*a*, the two syringes 12 and 14 are engaged. Initially, the primary syringe 14 includes a fluid F1 while the secondary syringe 12 is empty with its plunger 26 sealing the engagement tip 28. Once the two syringes are engaged, the plunger 40 of the primary syringe is depressed to push the fluid F1 into the secondary syringe 12. The plunger 26 of the secondary syringe may be simultaneously withdrawn to assist in the fluid transfer. In some circumstances, the secondary syringe may carry a fluid, granular material or other substance to be mixed with the fluid F1.

With the primary plunger 40 at the distal end of the primary syringe 14, the stopper tip 57 is aligned with the nozzle 34 of the primary syringe. In one embodiment, the stopper tip 57 is sized to fit within the nozzle 34. In the specific embodiment, the stopper tip has an outer diameter of 0.047 in. that is substantially equal to the nozzle diameter. The additive syringe 16 is then depressed within the barrel 30 of the primary syringe 14, as depicted in FIG. 11*b*. With this motion, the needle 70 pierces the stopper tip 57 and extends into the nozzle 34. The needle 70 may be sized to extend directly into the chamber 24 of the secondary syringe 12 or to extend just within the nozzle 34 or engagement cavity 38 of the primary syringe 14.

Once the needle has pierced the stopper tip 55, the plunger 68 may be depressed to introduce the second fluid F2 into the secondary syringe 12, as shown in FIG. 11*b*. Once the second fluid has been introduced, the additive syringe 16 may be removed. Alternatively, an additional additive syringe may be used to introduce a third fluid to the mixture, in which case the step of FIG. 11*b* is repeated.

Once the additional fluid(s) have been introduced into the mixing apparatus with the original fluid F1 the plungers 26, 40 of the two syringes 12, 14, are manipulated back and forth as shown in FIG. 11*c*. This movement drives the combined fluids through the reduced diameter nozzle 34 of the primary syringe 14 to ensure complete and rapid mixing of the two components. Once the fluids are fully mixed the solution/suspension may be drawn into one of the two syringes and the syringes separated. A needle or other delivery device may then be engaged to the syringe to dispense the mixed fluid.

It can be appreciated that when the additive syringe is removed from the primary syringe, the stopper 55 resiliently seals where the needle 70 had pierced. The stopper tip 57 projects from the distal face of the stopper to eliminate holdup volume that could trap air. In a specific embodiment, the stopper tip projects about 0.100 in. from the distal face of the stopper. At least the stopper tip 57 and preferably the entire stopper 55 is formed of a resilient material such as silicone rubber.

As described above, the syringe-to-syringe mixing systems are hand supported. Gripping elements can be added to the syringes to facilitate gripping of the syringes and manipulation of the syringe plungers. Alternatively, a fixture can be provided to support the syringes and/or mixing apparatus. Furthermore, while the illustrated embodiments contemplate manually operated syringes, the mixing apparatuses and nozzle inserts can also be used with powered fluid dispensing systems.

The plunger 40 of the first syringe 14 may be modified to incorporate a septum at one end of the lumen 46 or disposed within the lumen. The septum would be pierced by the needle 70, seal about the needle, and seal after the needle is removed, in the same manner as the stopper 55 described above. With this modification, the stopper may be replaced with a plunger head according to a two piece syringe construction.

Figure 12:
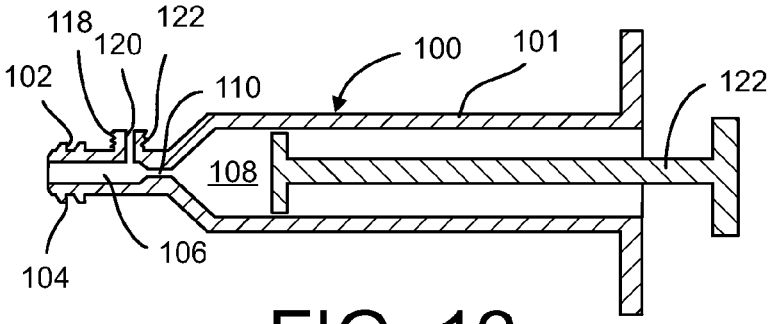
FIG. 12 is a side cross-sectional view of a mixing syringe according to a further disclosure herein.
Figure 13:
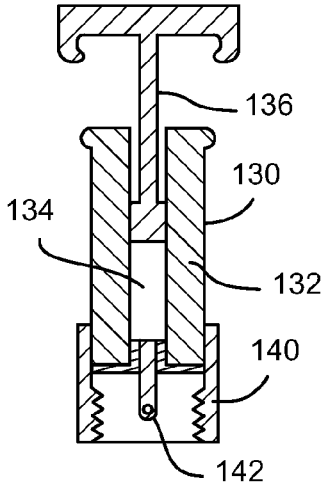
FIG. 13 is a side cross-sectional view of an injector for use with the mixing syringe shown in FIG. 12.

In another syringe-to-syringe mixing apparatus, one of the syringes may be constructed as shown in FIGS. 12-13. The syringe 100 includes a barrel that defines a chamber 108 to receive a standard plunger 122. The barrel terminates in an outlet 102, the distal end 104 of which is configured for mating engagement with the other syringe of the apparatus. Thus, the distal end 104 may be configured as a LUER® fitting. The outlet 102 defines a passageway 106 that communicates with the chamber 108. The syringe 100 includes a hub 118 extending transversely from the outlet 102. The hub defines a lumen 120 therethrough and a fitting 122 for engagement with an injector assembly 130, shown in FIG. 13. The lumen 120 incorporates or is in the form of a septum that seals the lumen and passageway 106.

The injector assembly 130 includes a barrel 132 defining a chamber 134 for slidably receiving a plunger 136. The end of the chamber 134 terminates in a needle 142 that is adapted to pierce the septum of the lumen 120. The barrel includes an engagement fitting 142 that is configured to mate with the fitting 122 of the hub 116. The engagement between the two components may be by a LUER® fitting, a threaded fitting or other suitable fluid-tight engagement.

In use, the syringe 100 is engaged to a secondary syringe, such as the syringe 12 described above. When the two syringes are coupled, the injector assembly 130 may be mounted to the hub 118. As the fitting 140 is engaged to the syringe fitting 122, the needle 142 pierces the septum of the lumen 120. The plunger 136 can be depressed to inject the contents of the injector assembly into the passageway 106 to mix with the contents of the coupled syringes. The coupled syringes may then be manipulated as described above to completely mix the constituents.

What is claimed is:

1. A syringe-to-syringe mixing apparatus comprising:

a first syringe including a first hollow barrel having an outlet and defining a first chamber for containing a fluid;

a second syringe including a second hollow barrel having an outlet and defining a second chamber for containing a fluid, said second syringe including a second plunger slidably disposed within said second barrel, the first and second syringes adapted to be coupled at the respective outlets to fluidly connect said first and second chambers;

said first syringe including a first plunger slidably disposed within said first barrel, said first plunger having a hollow plunger barrel defining a plunger chamber and having a distal end defining a lumen therethrough in communication between said plunger chamber and said first chamber when said plunger is disposed within said first barrel, said first syringe defining a nozzle at said outlet configured to increase the velocity of fluid flowing therethrough under pressure from one of said first and second plunger when the first and second syringes are coupled, said first plunger including a stopper mounted over the distal end of said first plunger closing said lumen, said stopper including an elongated tip defining a septum, said tip being substantially axially aligned with said lumen in said first plunger and having a configuration extending into said nozzle; and a third syringe slidably disposed within said hollow plunger barrel of said first plunger, said third syringe defining a cavity for containing a fluid and a third plunger slidably disposed within said cavity, said third syringe including a hollow needle having a configuration and extent to pierce said septum and extend into said nozzle, said needle being in fluid communication with said cavity.

2. The syringe-to-syringe mixing assembly of claim 1, wherein said needle is of extent to extend into said second chamber of said second syringe when the first and second syringes are coupled.

3. The syringe-to-syringe mixing assembly of claim 1, wherein said stopper is formed of a resilient material adapted to be pierced by said needle.

4. A syringe assembly for use with another syringe in a syringe-to-syringe mixing assembly, said syringe assembly comprising:

a first syringe including a first hollow barrel having an outlet and defining a first chamber for containing a fluid, said first syringe configured to be coupled to another syringe to fluidly connect the syringes;

a first plunger slidably disposed within said first barrel, said first plunger having a hollow plunger barrel defining a plunger chamber and having a distal end defining a lumen therethrough in communication between said plunger chamber and said first chamber when said plunger is disposed within said first barrel, said first syringe defining a nozzle at said outlet configured to increase the velocity of fluid flowing therethrough under pressure from said first plunger when the first syringe is coupled to another syringe, said first plunger including a stopper mounted over the distal end of said first plunger closing said lumen, said stopper including an elongated tip defining a septum, said tip being substantially axially aligned with said lumen in said first plunger and having a configuration extending into said nozzle; and an additional syringe slidably disposed within said plunger barrel, said additional syringe defining a cavity for containing a fluid and a plunger slidably disposed within said cavity.

5. The syringe assembly of claim 4, wherein:

said additional syringe includes a hollow needle configured to pierce said septum, said needle in fluid communication with said cavity, said hollow needle having a configuration and extent to pierce said septum and extend into said nozzle.

6. The syringe assembly of claim 5, wherein said stopper is formed of a resilient material adapted to be pierced by said needle.

* * * * *